US006267627B1

(12) United States Patent
Lin

(10) Patent No.: US 6,267,627 B1
(45) Date of Patent: Jul. 31, 2001

(54) ELECTRICAL PLUG WITH REMOVABLE FUSE

(76) Inventor: Tien-Hui Lin, P.O. Box No. 6-57, Chung-Ho City, Taipei Hsien 235 (TW)

( * ) Notice: Subject to any disclaimer, the term of this patent is extended or adjusted under 35 U.S.C. 154(b) by 0 days.

(21) Appl. No.: 09/444,664

(22) Filed: Nov. 22, 1999

(51) Int. Cl.[7] ..... H01R 13/68
(52) U.S. Cl. ..... 439/622; 439/621; 439/106
(58) Field of Search ..... 439/106, 621, 439/622

(56) References Cited

U.S. PATENT DOCUMENTS 3,744,003 * 7/1973 Dipace ..... 339/31 B
3,976,967 * 8/1976 Magherini ..... 337/211
4,679,884 * 7/1987 Klemp ..... 439/106
5,318,460 * 6/1994 Gilbert ..... 439/621
5,634,818 * 6/1997 Deng ..... 439/622
5,820,413 * 10/1998 Yamada et al. ..... 439/621
5,876,250 * 3/1999 Deng ..... 439/622
6,074,252 * 6/2000 Grieve ..... 439/622

* cited by examiner

*Primary Examiner*—Gary Paumen
*Assistant Examiner*—Sean McCamey
(74) *Attorney, Agent, or Firm*—Dougherty & Troxell

(57) ABSTRACT

A power plug having a housing, a bus fuse, two power prongs, one ground prong, and a cover. The bus fuse is held in mounting appendages at the two sides of a chamber cover such that the bus fuse enters an internal chamber when the chamber cover is placed on the housing. A notch formed on each of the two ends of the chamber cover facilitates removal. The chamber has a downward oriented opening and four insertion holes and a post formed along the center and two sides provide for the insertion of two power prongs and one ground prong, which in conjunction with the bus fuse forms a protective circuit. The cover of the housing has a hand hold on the side to facilitate removal from mains outlets.

3 Claims, 4 Drawing Sheets

ELECTRICAL PLUG WITH REMOVABLE FUSE

BACKGROUND OF THE INVENTION

1. Field of the Invention

The invention relates to an improved indoor extension cord power plug that has an easily replaceable protective bus fuse contained in the chamber of the invention and, furthermore, provides for the safe and practical insertion and removal of the present invention into and from mains outlets to achieve economical performance.

2. Description of the Prior Art

In an age of growing technological development, people have become more particular about products for daily life, including various electrical lighting fixtures which are necessary appliances in all households. Since such lighting fixtures require indoor extension cord power plugs, manufacturers have researched and developed indoor extension cord power plugs with built-in protective fuses to increase their safety and practicality as well as prolong the service life of home lighting appliances.

Conventional indoor extension cord power plugs are physically large and heavy and, furthermore, if a fuse is installed in the plug, it is usually situated between the upper and lower housings that are assembled together by means of screw fasteners or fusion. When such a plug is inserted into a mains outlet, the remaining socket of the mains outlet is readily blocked due to its large size, precluding usage by other electrical appliances. Furthermore, the excessive weight increases the cost of materials and leads to user inconvenience, especially since the plug has to be disassembled to replace a burned out fuse, a time and labor consuming task.

Another type of indoor extension cord power plug available on the market has a vertical opening at the front between the prongs for installing the fuse such that when the fuse is expended and must be replaced, needle nosed pliers or other similar tool is utilized to extricate the fuse. This is also inconvenient to the user and, furthermore, the prongs are easily broken, bent, or sheared in the process which results in poor conductance when the plug is inserted into a mains outlet.

In view of the shortcomings and inconveniences of conventional indoor extension cord power plugs, the inventor of the invention herein, based on many years experience in the related industry and with the specialized technology, successfully researched and developed the improved structure indoor extension cord power plug of the invention herein.

SUMMARY OF THE INVENTION

Therefore, the primary objective of the invention is to provide an improved indoor extension cord power plug that allows easy fuse replacement and dependable safety, wherein the bus fuse is held in mounting appendages at the two sides of a chamber cover such that the bus fuse enters an internal chamber when the chamber cover is placed on the housing. A notch is formed on each of the two ends of the chamber cover to facilitate removal. The chamber has a downward oriented opening, four insertion holes, and a post formed along the center and two sides of its bottom section to provide for the insertion of two power prongs and one ground prong, which in conjunction with the bus fuse forms a protective circuit. The cover is installed on the housing, which has a hand hold on the side to facilitate removal from the mains outlets. The structure of the present invention permits the convenient replacement of the bus fuse in the chamber as well as the safe and practical insertion and removal of the present invention into and from mains outlets to achieve economical performance.

Another objective of the invention is to provide an improved indoor extension cord power plug of compact size, configuration, and weight which is lighter than a conventional power plug.

To enable further understanding of the function, structure, and other innovative aspects of the present invention, the brief description of the drawings below is followed by the detailed description of the preferred embodiments.

DETAILED DESCRIPTION OF THE PREFERRED EMBODIMENTS

Figure 1:
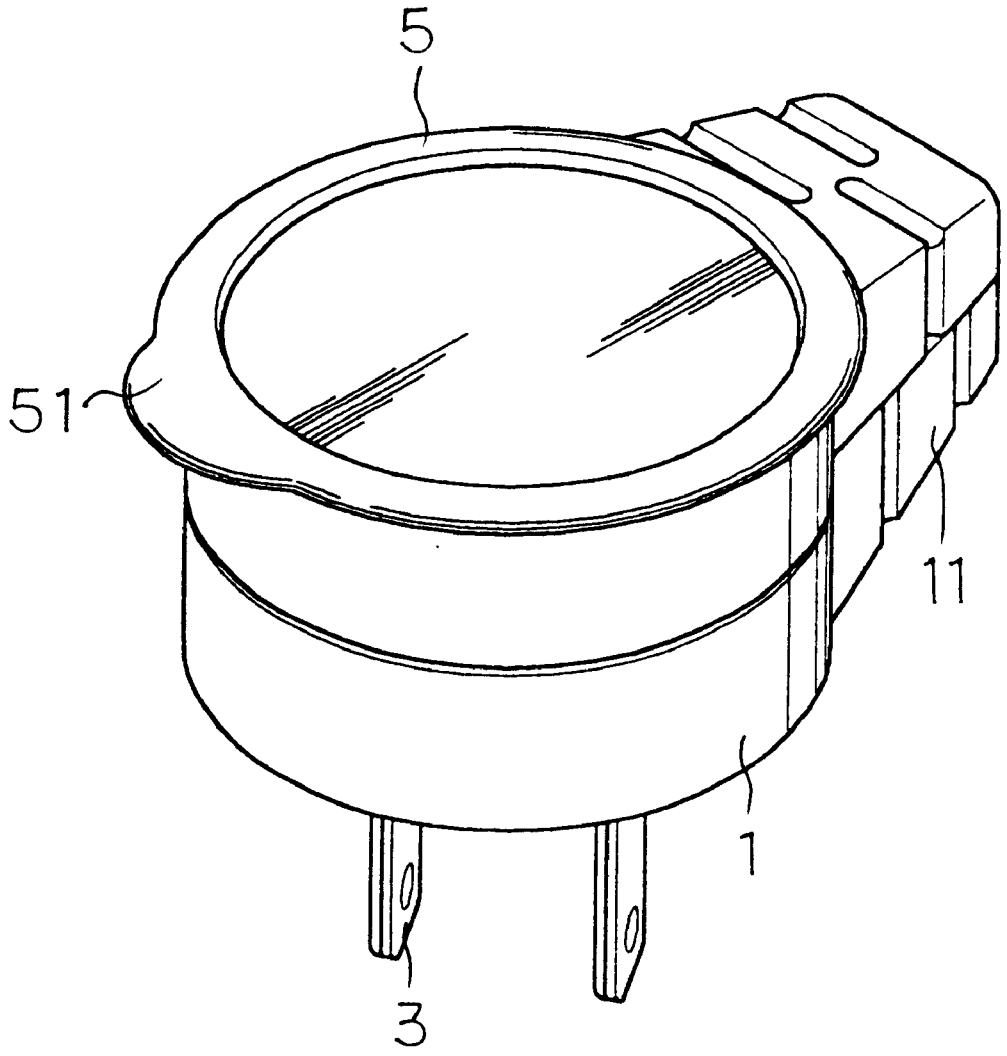
FIG. 1 is an isometric drawing of the invention herein.
Figure 2:
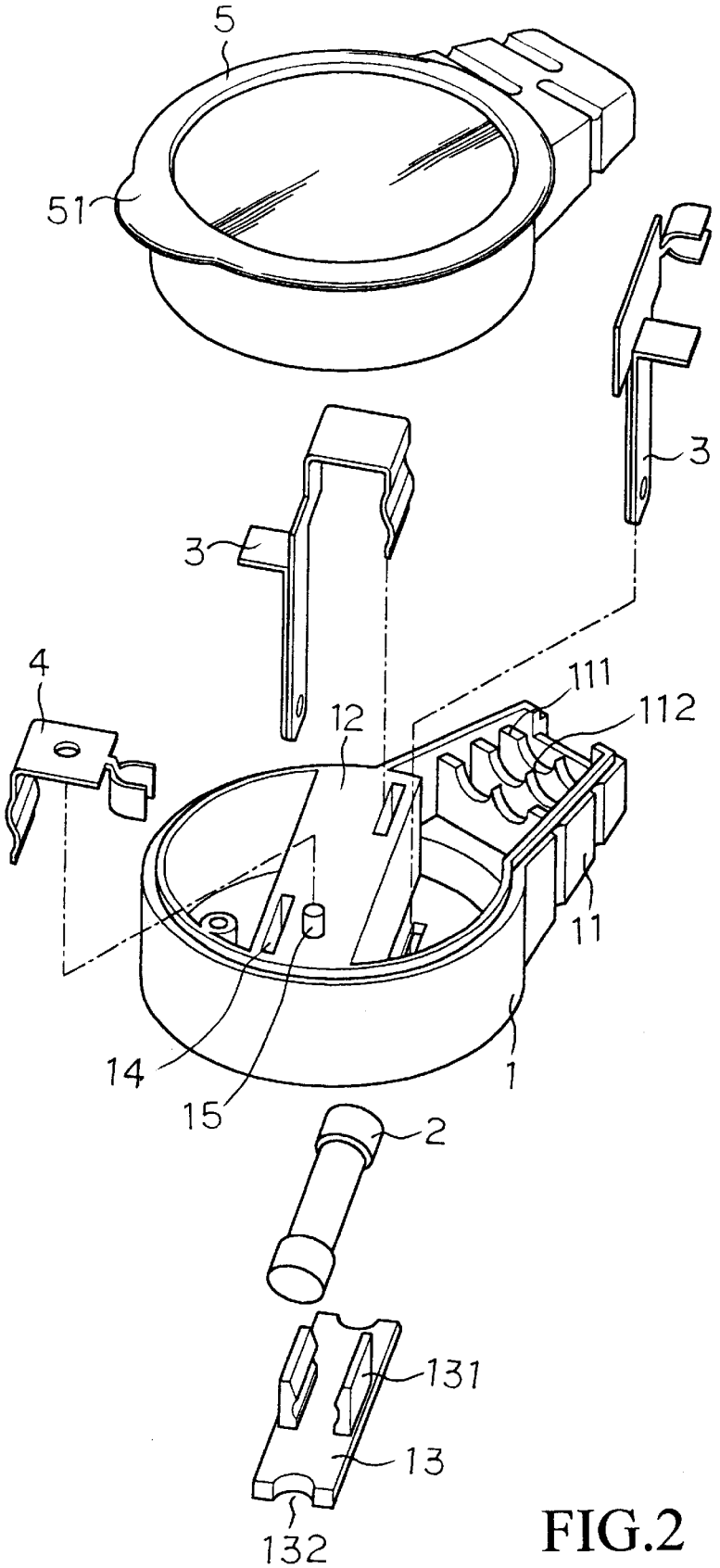
FIG. 2 is an exploded drawing of the invention herein.
Figure 3:
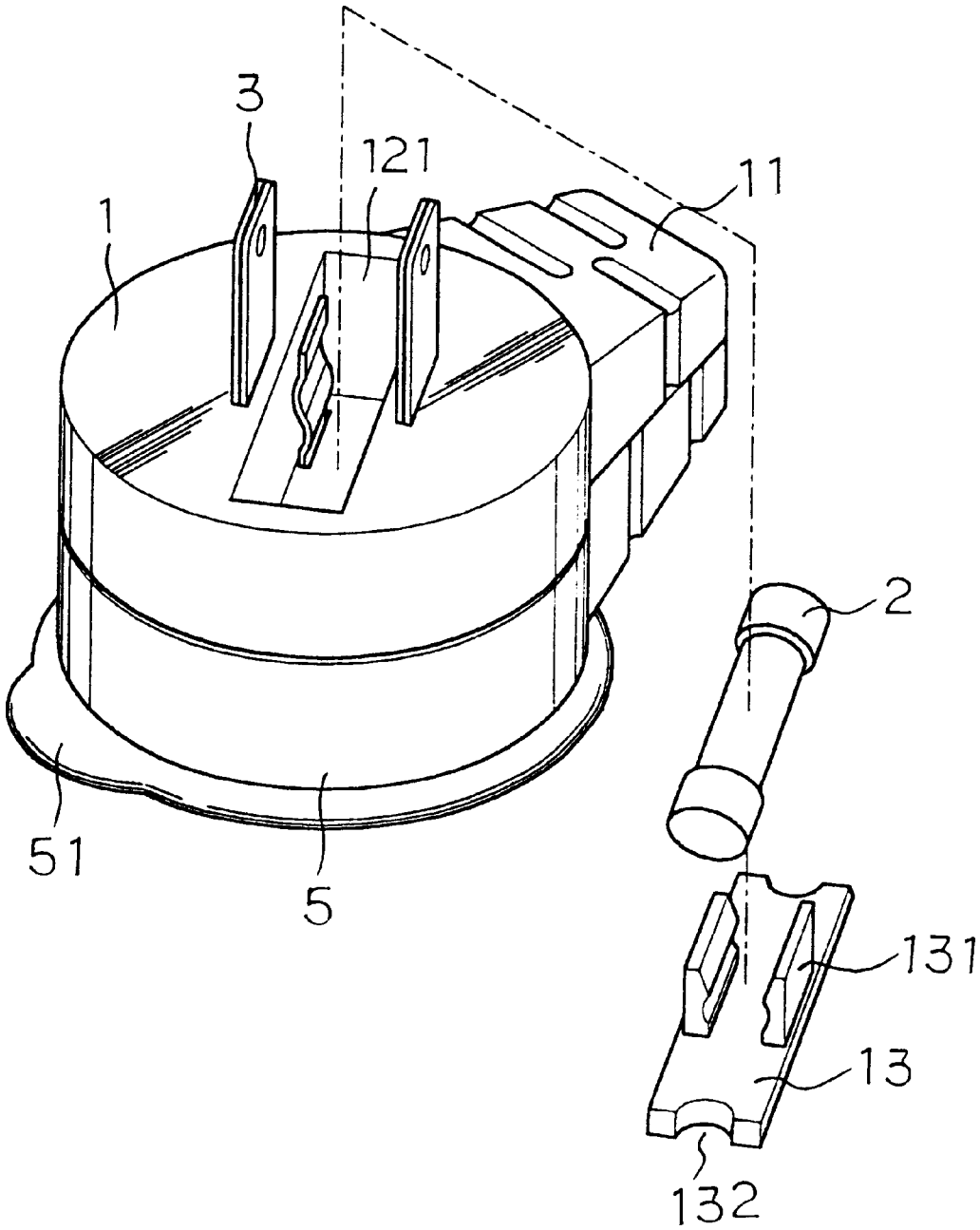
FIG. 3 is an isometric drawing of the replaceable fuse of the invention herein.

Referring to FIG. 1, FIG. 2, and FIG. 3, the invention is comprised of a housing 1 of cylindrical profile, a bus fuse 2, two power prongs 3, one ground prong 4, and a cover 5; a wiring channel 11 is disposed on one side of the housing 1 and there are three positioning ribs 111 along the wiring channel 11, with two grooves 112 formed in each of the positioning ribs 111 for wiring placement. A chamber 12 and a chamber cover 13 are contained in the housing 1 and mounting appendages 131 are formed at an appropriate area on each of the two sides of the chamber cover 13. The mounting appendages 131 are designed to hold the bus fuse 2 such that the bus fuse 2 enters the chamber 12 when the chamber cover 13 is placed on the chamber 12. A notch 132 is formed on each of the two ends of the chamber cover 13 to facilitate removal during fuse replacement, wherein a pen tip or other implement smaller than the notch 132 is utilized as a lever to pry the notch 132 outward to easily remove the chamber cover 13 to replace the bus fuse 2. In the design of the present invention, the opening 121 of the chamber 12 is situated in between the two power prongs 3, rectangular in shape, and has insertion holes 14 in the sides such that the insertion holes 14 and the post 15 on the bottom section provide for the insertion of the two power prongs 3 and the ground prong 4. The two power prongs 3 are inserted into the insertion holes 14 in the two sides of the chamber 12, enabling the prongs to be inserted into mains outlets. Ends of each power prong 3 are inserted into the insertion holes 14 in the bottom section of chamber 12, with the other insertion hole 14 and the post 15 providing for the insertion of the ground prong 4 thereby allowing the power prongs 3 and the ground prong 4 to extend out from the chamber 12 in a front-to-back juxtaposed arrangement, with the bus fuse 2 forming a protective circuit. The cover 5 is fitted to the housing 1 and secured in place by ultrasonic welding. A hand hold section 51 is provided at the side of the cover 5 to facilitate easy removal from the mains outlet. The structure permits the convenient replacement of the bus fuse 2 in the chamber 12 as well as the safe and practical insertion and removal of the present invention into and from the mains outlets to achieve economical performance.

Figure 4:
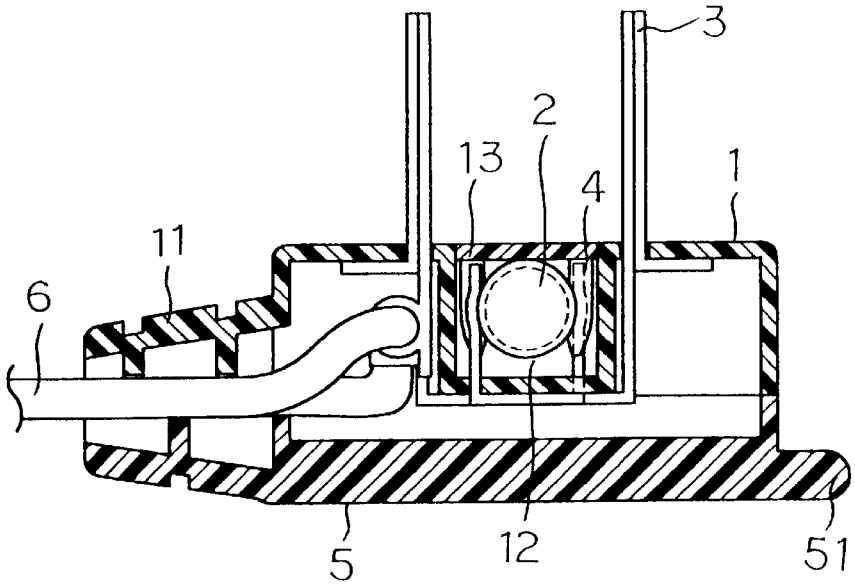
FIG. 4 is a cross-sectional drawing of the invention herein.
Figure 5:
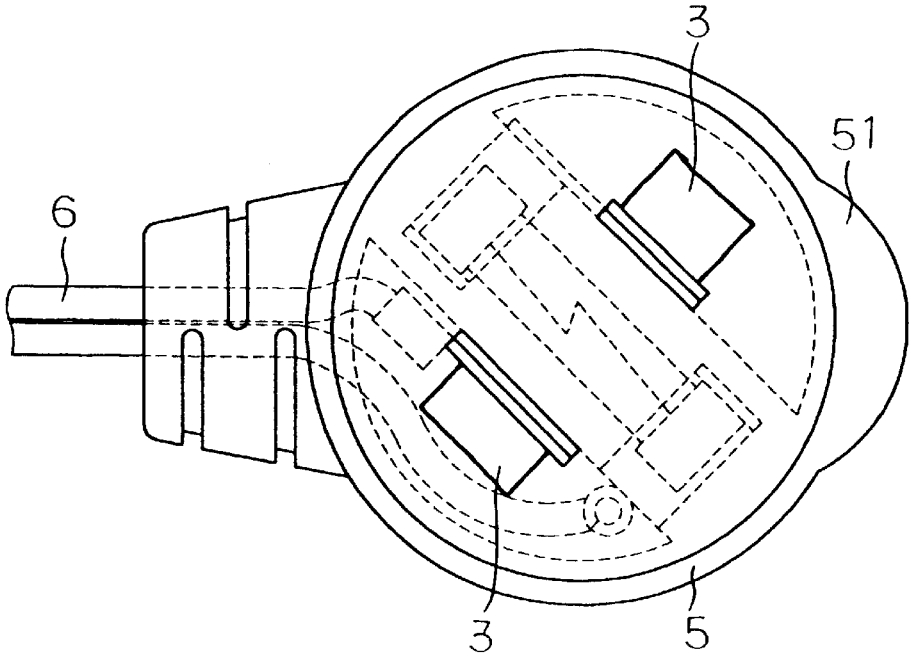
FIG. 5 is an orthographic drawing of the invention herein.

Referring to FIG. 4 and FIG. 5, a two-conductor cord 6 is routed over the positioning ribs 111 of the wiring channel 11, with one lead of the two-conductor cord 6 connected to the power prong 3 and the remaining lead of the two-conductor cord 6 connected to the ground prong 4, such that when the mains power is applied, the power prongs 3, the ground prong 4, and the bus fuse 2 form a protective circuit enabling the invention to have overload, voltage spike, and current surge protection capabilities. The invention is of compact size, configuration, and weight which is lighter than that of conventional power plugs and thereby offers more practical economic performance.

The description and drawings of the disclosure only relates to a single embodiment of the invention that shall not be construed as limitation of the actual scope and claims of the present invention and, furthermore, all modifications based on the structure and functions described above and listed in the claims shall remain within the protected scope and claims of the invention.

What is claimed is:

1. An electrical plug with a removable bus fuse comprising:

a) a housing having a cylindrical profile forming an inside chamber to accept the bus fuse therein, the chamber having an opening;

b) two power prongs mounted in the housing and extending externally of the housing, the power prongs located such that the opening of the chamber is between the two power prongs;

c) a ground prong mounted in the housing and extending into the chamber;

d) a cover removably attached to the housing so as to cover the opening of the chamber, the cover including two spaced apart mounting appendages for removably gripping the bus fuse therebetween; and, e) the bus fuse removably mounted on the cover by the mounting appendages such that when the cover is attached to the housing the bus fuse is electrically connected between one power prong and the ground prong, and when the cover is removed from the housing, the bus fuse remains mounted to the cover.

2. The electrical plug of claim 1 comprising a hand hold section extending outwardly from the cylindrical profile housing.

3. The electrical plug of claim 1 further comprising a notch formed in each of two opposite ends of the cover.

* * * * *